US005411302A

United States Patent [19]

Shimada

[11] Patent Number: 5,411,302

[45] Date of Patent: May 2, 1995

[54] POWERED CLOSING DEVICE

[75] Inventor: Junichi Shimada, Yokohama, Japan

[73] Assignee: Ohi Seisakusho Co., Ltd., Yokohama, Japan

[21] Appl. No.: 83,181

[22] Filed: Jun. 29, 1993

[30] Foreign Application Priority Data

Jun. 29, 1992 [JP] Japan ..... 4-45044 U
Jun. 29, 1992 [JP] Japan ..... 4-45045 U

[51] Int. Cl.[6] ..... E05C 3/06
[52] U.S. Cl. ..... 292/201; 292/DIG. 43; 292/DIG. 65
[58] Field of Search ..... 292/201, 216, DIG. 23, 292/DIG. 65, DIG. 43, DIG. 25, 341.16, 341.12

[56] References Cited

U.S. PATENT DOCUMENTS 3,378,291 4/1988 Brian ..... 292/68
4,892,340 1/1990 Matumoto ..... 292/201
4,941,696 7/1990 Yamada et al. ..... 292/341.12 X
5,180,198 1/1993 Nakamura et al. ..... 292/201
5,222,775 6/1993 Kato ..... 292/201

FOREIGN PATENT DOCUMENTS 0314075 5/1989 European Pat. Off. .
4-302683 10/1992 Japan .

*Primary Examiner*—Rodney M. Lindsey
*Attorney, Agent, or Firm*—Foley & Lardner

[57] ABSTRACT

An emergency mechanism is incorporated in a powered back door closing device of a motor vehicle. During the time when, with the aid of a driving mechanism, a drawing mechanism of the door closing device is pulling down the back door through a striker secured thereto, the emergency mechanism forces a locking plate of the closing device to pivot from a locking position to an unlocking position thereby to release the striker from the drawing mechanism. The emergency mechanism comprises a cam member which is powered by the drive mechanism and rotatable about its axis in both directions; and a cam follower member which is pivotally connected to the locking plate. The cam follower member is actuated by the cam member in such a manner that when the cam member is rotated in one direction, the cam follower member forces the locking plate to keep the locking position and when the cam member is rotated in the other direction, the cam follower member forces the locking plate to pivot from the locking position to the unlocking position.

13 Claims, 9 Drawing Sheets

POWERED CLOSING DEVICE

BACKGROUND OF THE INVENTION

1. Field of the Invention

The present invention relates in general to closing devices for motor vehicles and more particularly to powered closing devices for closing an automotive back door or the like by the force of an electric power. More specifically, the present invention is concerned with powered back door closing devices of a type which comprises a back door drawing mechanism mounted on a vehicle body and an electric power unit coupled with the back door drawing mechanism for powering the same, wherein when the back door is manually pivoted to an almost closed position, the back door drawing mechanism catches the back door and then enforcedly pulls down the same to a fully closed position.

2. Description of the Prior Art

In order to clarify the task of the present invention, one conventional powered back door closing device of the above-mentioned type will be outlined with reference to FIGS. 13 and 14, which is shown in Japanese Patent First Provisional Publication 4-3026683.

The back door closing device comprises generally a motor mounting plate 1 and a cover base plate 2 which are tightly connected through several struts 3 in a manner to define therebetween a certain space. A latch carrying plate 4 is installed in the space and pivotally connected to the cover base plate 2. The latch carrying plate 4 carries thereon a latch mechanism 5. An electric drive unit 6 is mounted on the motor mounting plate 1. An output shaft 6*a* of the electric drive unit 6 is connected through a joint mechanism 7 to a pivotally driving mechanism 8 supported by the cover base plate 2. Energizing the electric drive unit 6 induces upward and downward pivotal movement of the latch carrying plate 4 relative to the fixed cover base plate 2.

Upon assembly, the back door closing device is mounted on a rear portion of a motor vehicle where a back door is pivotally arranged, as may be understood from FIG. 1. The back door has a striker secured thereto.

When the back door of the vehicle is manually pivoted down to an almost closed position, the latch mechanism 5 of the closing device latches the striker of the back door and then upon energizing of the electric drive unit 6, the latch carrying plate 4 is pivoted down to pull the back door toward its fully closed position. Upon full closing of the back door, the electric drive unit 6 is deenergized. With this, the back door assumes the fully closed position. When, thereafter, the electric drive unit 6 is energized again, the latch carrying plate 4 is pivoted upward while canceling the engagement of the striker to the latch mechanism 5. With this, the back door is lifted to a released somewhat open position and thus the back door is ready for opening by hands.

However, due to its inherent construction, the above-mentioned conventional back door closing device has some drawbacks. One of them is a weak point which has been exposed when, during closing movement of the back door, a foreign thing accidentally gets between the door and the vehicle body. In this case, the closing movement of the back door is enforcedly stopped applying a marked load to the electric drive unit 6. In fact, in such a case, the latch mechanism 5 must be awkwardly handled to release the striker of the back door for removing the foreign thing, or wiring of the electric drive unit 6 must be changed to run the motor of the unit 6 in a reversed direction for returning or lifting the back door to the released somewhat open position. However, these operation steps are difficult or at least troublesome.

Another weak point is the sway movement of the striker of the back door, which takes place when the back door is pulled down or pushed up by the closing device. Such sway movement of the striker is inevitably caused by the pivotal movement of the latch carrying plate 4. In fact, it has not been easy to provide the back door with a stable closed position when such pivotal drawing mechanism is employed.

SUMMARY OF THE INVENTION

It is therefore an object of the present invention to a back door closing device which is free of the above-mentioned drawbacks.

According to a first aspect of the present invention, there is provided a powered closing device for use in a structure wherein a first member is pivotally connected to a second member. The powered closing device comprises a striker secured to the first member to move therewith; a drawing mechanism mounted on the second member for catching and pulling down the striker to a certain lower position, the drawing mechanism including a supporting base plate secured to the second member, a latch mounting plate pivotally connected to the supporting base plate, a latch plate pivotally connected to the latch mounting plate and pivoting between a latch position to latch the striker and an unlatch position to release the striker, and a locking plate pivotally connected to the latch mounting plate and pivoting between a locking position to lock the latch plate at the latch position and an unlocking position to release the latch plate; a drive mechanism for driving the latch mounting plate to pivot between upper and lower positions by the force of electric power; and an emergency mechanism which, during the time when the drawing mechanism is pulling down the striker with the aid of the driving mechanism, forces the locking plate to pivot from the locking position to the unlocking position thereby to release the striker from the drawing mechanism, wherein the emergency mechanism comprises a cam member powered by the drive mechanism, the cam member being rotatable about its axis in both one and the other directions; and a cam follower member pivotally connected to the locking plate, the cam follower member being actuated by the cam member in such a manner that when the cam member is rotated in one direction, the cam follower member forces the locking plate to keep the locking position and when the cam member is rotated in the other direction, the cam follower member forces the locking plate to pivot from the locking position to the unlocking position.

According to a second aspect of the present invention, there is provided a powered closing device for use in a structure wherein a first member is pivotally connected to a second member. The powered closing device comprises a striker secured to the first member; a drawing mechanism mounted on the second member for catching and pulling down the striker to a certain lower position, the drawing mechanism including a supporting base plate secured to the second member, a latch mounting plate movable vertically along a given straight way relative to the supporting base plate, a latch plate pivotally connected to the latch mounting plate and pivoting between a latch position to latch the striker and an unlocking position to release the striker, and a locking plate pivotally connected to the latch mounting plate and pivoting between a locking position to lock the latch plate at the latch position and an unlocking position to release the latch plate; a drive mechanism for driving the latch mounting plate to move upward and downward relative to the supporting base plate by the force of electric power; a wedge-shaped damper member mounted to the striker; and means defining in the supporting base plate a generally triangular recess into which the striker can be inserted; and means defining in the latch mounting plate a generally triangular recess into which the striker can be inserted; wherein the recesses of the supporting base plate and the latch mounting plate are so shaped as to tightly hold the wedge-shaped damper member when the first member assumes a given angular position relative to the second member.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
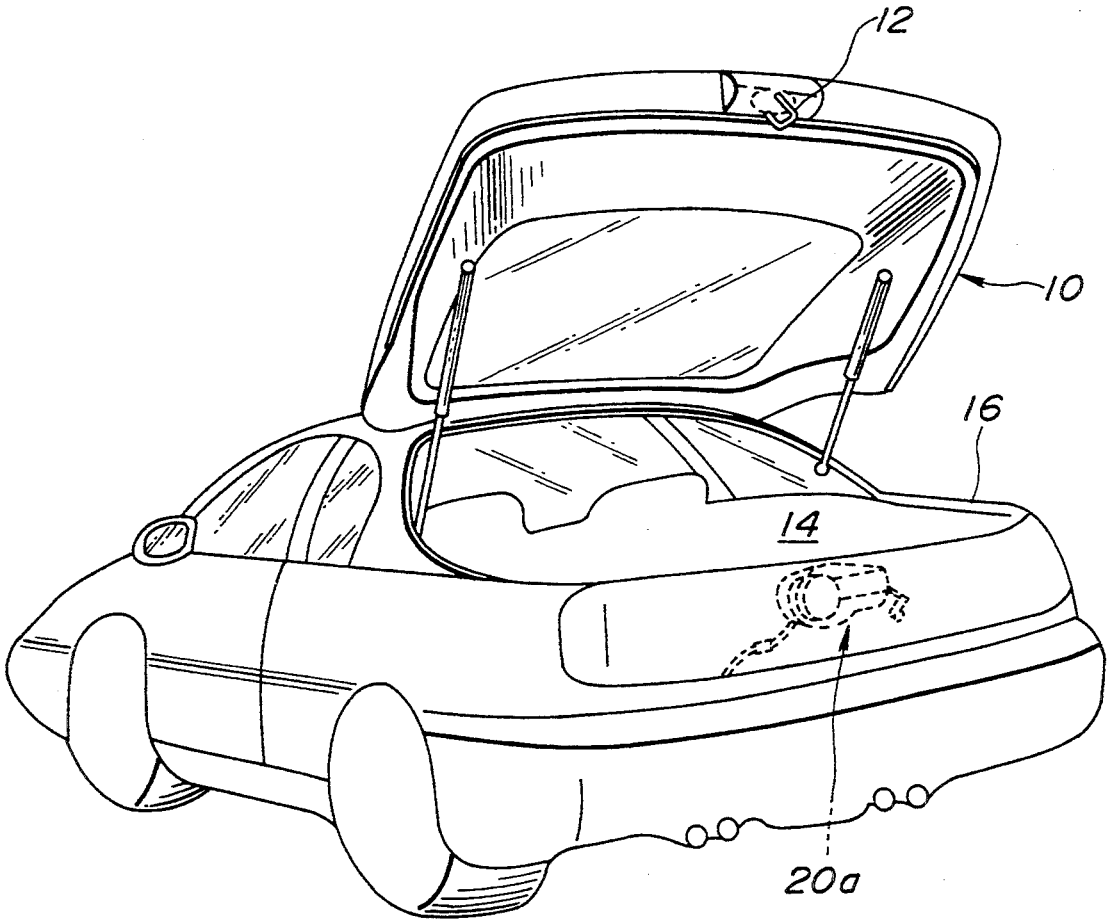
FIG. 1 is a rear view of a motor vehicle with a pivotal back door, to which a back door closing device of the present invention is applied.

Referring to FIGS. 1 to 10, there is shown a powered back door closing device which is a first embodiment of the present invention.

As is seen from FIG. 1, the back door closing device of the invention, which will be described in detail hereinafter, is applied to a back door 10 of a passenger motor vehicle. The back door 10 is pivotally connected at its front end to a rear upper portion of the vehicle, so that the door 10 can selectively close and open a rear window opening 14 of the vehicle. Designated by numeral 16 is a peripheral edge portion of the rear window opening 14. Although not shown in the drawing, a conventional weather strip extends along the periphery 16 of the opening 14.

As shown, the back door 10 has at its free end portion a striker 12 secured thereto and the vehicle body has at a rear end of the rear window opening 14 a back door drawing mechanism 20*a* mounted thereto. As will become apparent as the description proceeds, when the back door 10 is pivoted down to an almost closed position, the back door drawing mechanism 20a catches the striker 12 and then pulls down through the striker 12 the back door 10 into a fully closed position by the force of electric power.

Figure 2:
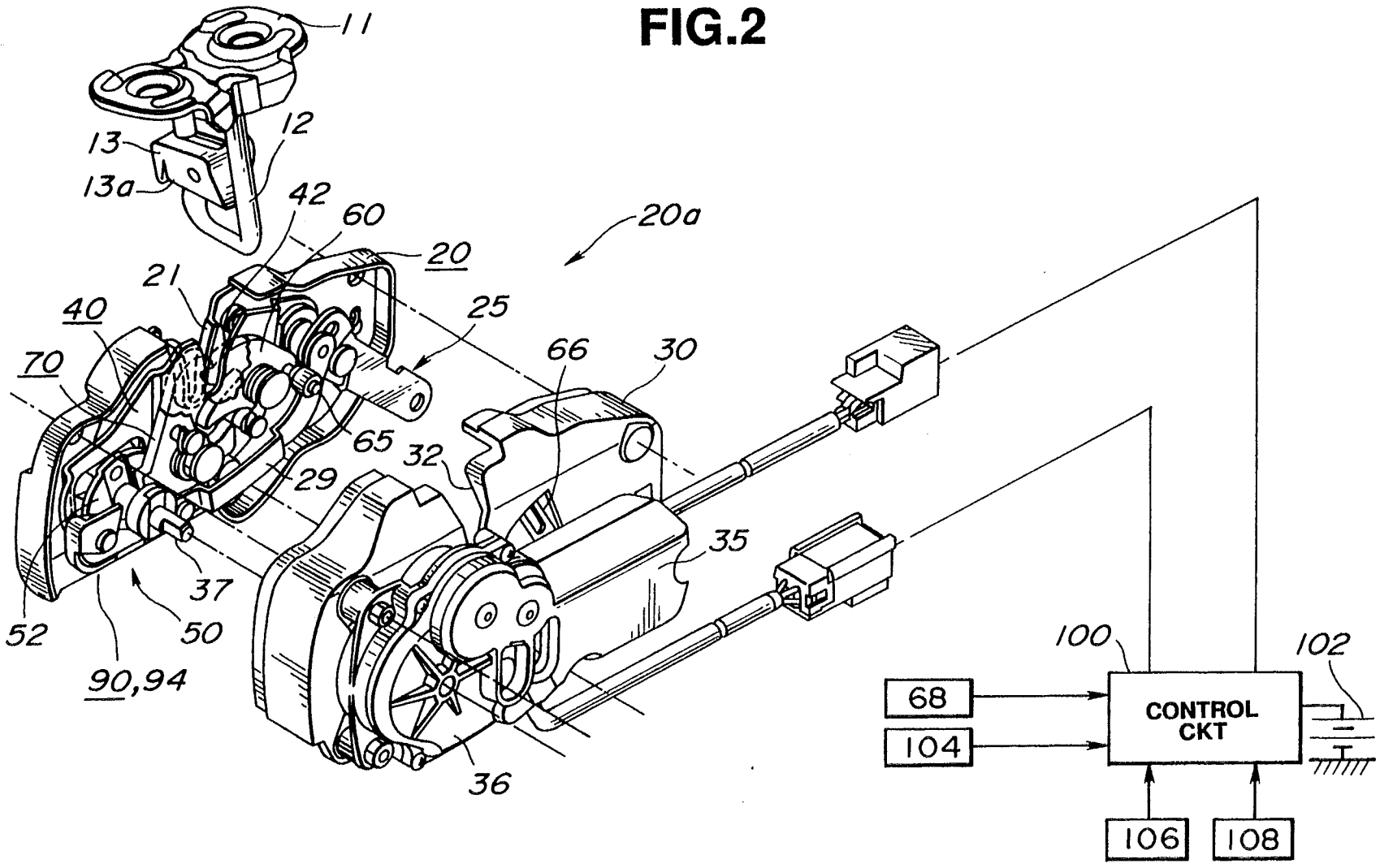
FIG. 2 is a partially cut perspective view of the back door closing device of the invention.
Figure 3:
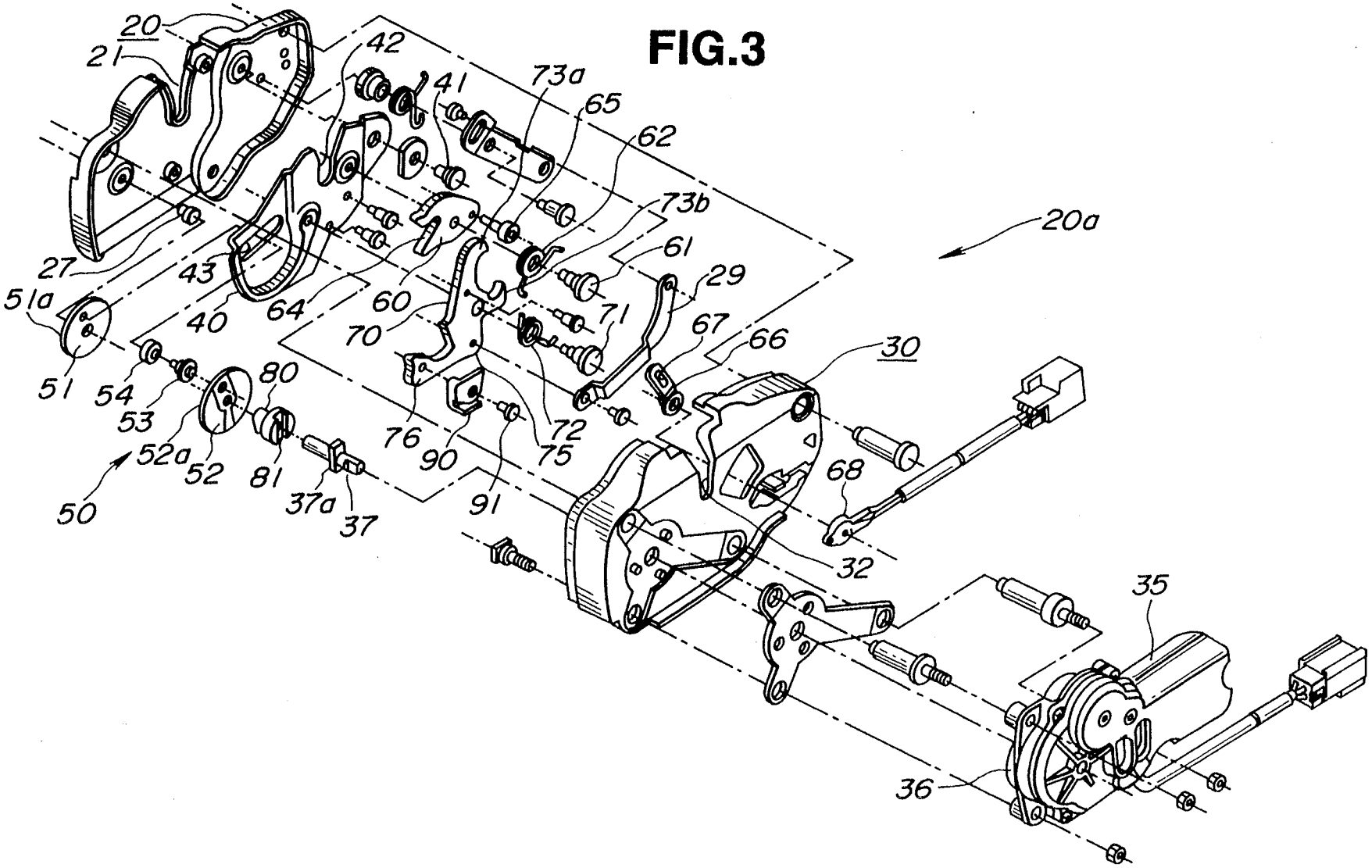
FIG. 3 is an exploded view of a body-mounted mechanism of the back door closing device.

As is seen from FIGS. 2 and 3, the back door drawing mechanism 20*a* comprises a supporting base plate 20 secured to the rear end of the rear window opening 14, a motor mounting plate 30 connected to the supporting base plate 20 in a manner to overlap the same, and a latch mounting plate 40 pivotally installed between the supporting base plate 20 and the motor mounting plate 30. The supporting base plate 20 and the motor mounting plate 40 thus constitute a supporting base structure (20+40).

As is best seen from FIG. 3, the supporting base plate 20 is formed at its upper portion with a generally triangular recess 21 into which the striker 12 of the back door 10 can be inserted. The supporting base plate 20 is equipped at one lateral end portion with an unlocking mechanism 25. As will be described hereinafter, when a key cylinder (not shown) mounted in the rear end of the vehicle body is turned in a given direction by a key, the unlocking mechanism 25 functions to release the striker 12 from the back door drawing mechanism 20*a*. The supporting base plate 20 is equipped at the other lateral end portion with a drive mechanism 50 which drives the latch mounting plate 40 to pivot upward and downward.

Figure 4:
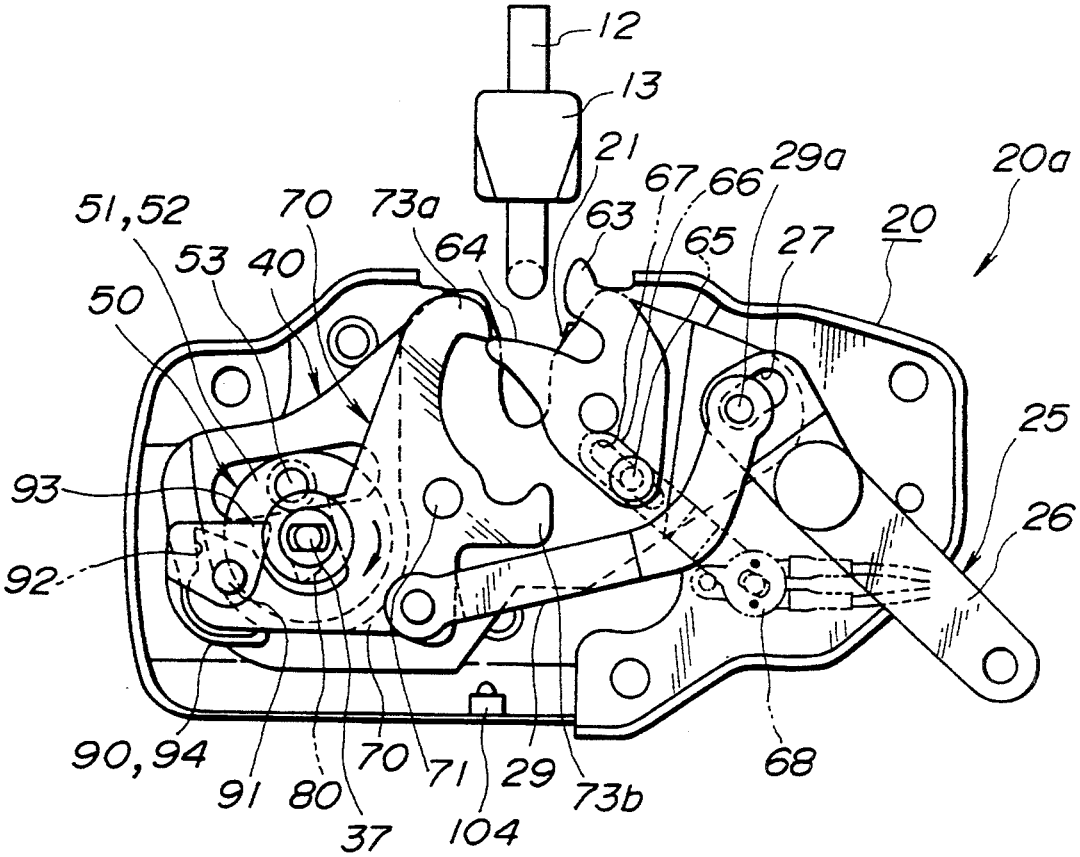
FIGS. 4 to 9 are front views of the back door closing device of the invention in different conditions.

As is understood from FIG. 4, the unlocking mechanism 25 comprises an output lever 26 which is pivotally connected to the supporting base plate 20. The output lever 26 is formed at one end with an elongate slot 27 with which a stud member 29*a* provided on one end of a connecting rod 29 is slidably engaged. The connecting rod 29 extends toward the drive mechanism 50 and is pivotally connected at the other end to a locking plate 70.

The drive mechanism 50 is a so-called "toggle mechanism", which, as is seen from FIG. 3 comprises a pair of circular output members 51 and 52 which are arranged to put therebetween the latch mounting plate 40. The circular output member 51 is rotatably connected through a pivot shaft 27 to the supporting base plate 20, and the other circular output member 52 is rotatably connected through an output shaft 37 to the motor mounting plate 30. As will be described hereinafter, the output shaft 37 is powered by an electric motor 35. The pivot shaft 27 and the output shaft 37 lie on a common axis. An output pin 53 extends between respective peripheral portions 51a and 52a of the paired circular output members 51 and 52. The output pin 53 has a sleeve 54 rotatably disposed thereon. The sleeve 54 is slidably engaged with an elongate slot 43 which is formed in the latch mounting plate 40. Thus, upon rotation of the paired circular output members 51 and 52, the latch mounting plate 40 is forced to make a pivotal movement relative to the supporting base structure (20+40).

The circular output member 52 has a cam member 80 connected thereto to rotate therewith. The cam member 80 has a through bore through which the output shaft 37 passes. The cam member 80 is formed with a key groove 81 with which a key 37*a* integral with the output shaft 37 is latchedly engaged. Thus, the output shaft 37, the cam member 80, the circular output member 52 and the other circular output member 51 rotate together like a unit.

As is best seen from FIG. 2, the motor mounting plate 30 is formed at its upper portion with a generally triangular recess 32 which is in agreement with the triangular recess 32 of the supporting base plate 20. The motor mounting plate 30 has at its outer surface an electric motor 35 mounted thereto. As shown, the motor 35 lies along the longitudinal axis of the motor mounting plate 30. The electric motor 35 has a speed reduction gear 36 incorporated therewith. The above-mentioned output shaft 37 extends from the speed reduction gear 36. As shown, two electric cables from the electric motor 35 extend to a control circuit 100 which is powered by a rechargeable battery 102 mounted on an associated motor vehicle.

As is seen from FIG. 3, the latch mounting plate 40 has one end which is pivotally connected through a pivot shaft 41 to the supporting base plate 20. Thus, as has been mentioned hereinabove, the latch mounting plate 40 is permitted to pivot upward and downward about the pivot shaft 41 upon rotation of the output shaft 37 of the drive unit (35+36).

The latch mounting plate 40 is formed at its upper portion with a generally triangular recess 42 which becomes in agreement with the triangular recess 21 of the supporting base plate 20 when the latch mounting plate 40 comes to its upper position. For the reason which will become clear hereinafter, one side of the peripheral edge of the triangular recess 42 somewhat bulges as compared with the other side.

As will become apparent as the description proceeds, when the striker 12 of the back door 10 deeply comes into the aligned triangular recesses 21, 42 and 32 of the back door drawing mechanism 20a, a wedge-shaped damper member 13 (see FIG. 2) fixed to the striker 12 resiliently abuts against inclined opposed edges of the recesses 21, 42 and 32. The wedge front portion of the damper member 13 is designated by numeral 13*a*.

As is understood from FIG. 3, a latch plate 60 is pivotally connected through a pivot shaft 61 to the pivotal latch mounting plate 40. The latch plate 60 pivots between a latch position wherein the latch plate 60 latches the striker 12 and an unlatch position wherein the latch plate 60 releases the striker 12. The aforementioned locking plate 70 is pivotally connected through a pivot shaft 71 to the latch mounting plate 40 at a position opposite to the position where the latch plate 60 is located with respect to the triangular recess 42. The locking plate 70 pivots between a locking position wherein the locking plate 70 locks the latch plate 60 at the latch position and an unlocking position wherein the locking plate 70 cancels the locked condition of the latch plate 60. A spring 62 is connected to the latch plate 60 to bias the same toward the unlatch position, that is, in a counterclockwise direction in FIG. 3. Another spring 72 is connected to the locking plate 70 to bias the same toward the locking position, that is, in a clockwise direction in FIG. 3.

As is seen from FIGS. 3 and 4, the locking plate 70 is generally in the shape of letter "L", which has at one upper end a locking pawl 73*a* which can lock the latch plate 60 at the latch position. To the junction part 75 of the L-shaped locking plate 70, there is pivotally connected through a pivot pin (no numeral) the afore-mentioned connecting rod 29, and to the other lower end 76 of the locking plate 70, there is pivotally connected through a pivot pin 91 a cam follower member 90.

Figure 10:
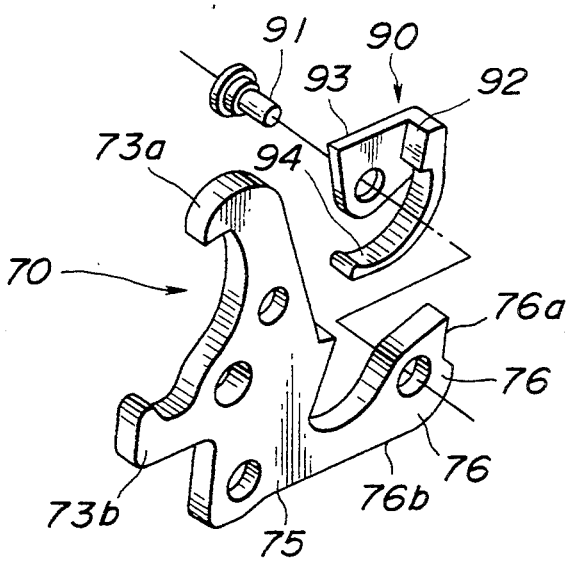
FIG. 10 is a perspective view of an emergency mechanism employed in the back door closing device of the invention.

As is seen from FIG. 10, the cam follower member 90 has a stopper portion 92 which can abut against a tail end surface 76*a* of the locking plate 70 to suppress rotation of the cam follower member 90 relative to the locking plate 70. That is, as viewed in FIG. 4, upon the abutment, the cam follower member 90 is prevented from making a clockwise rotation. The cam follower member 90 has further an engaging portion 93 against which the above-mentioned cam member 80 abuts. The cam follower member 90 has further a curved tongue portion 94 whose leading end is projected upward. The projected end of the tongue portion 94 resiliently abuts against the lower surface 76*b* of the locking plate 70. That is, as viewed in FIG. 4, due to this resilient abutment, the cam follower member 90 is biased in a clockwise direction.

The cam member 80 and the cam follower member 90 constitute a so-called "emergency mechanism".

As is seen from FIG. 3, the latch plate 60 has a pin 65 secured thereto. The pin 65 is slidably engaged with an elongate slot 67 formed in a detection lever 66 which is pivotally connected to the supporting base plate 20. To a pivoted portion of the detection lever 66, there is mounted a rotary switch 68 which detects the position of the detection lever 66 and thus detects the position of the latch plate 60. As shown in FIG. 2, the rotary switch 68 is connected to the control circuit 100.

As is understood from the same drawing (FIG. 2), a timer 106 is connected to the control circuit 100, which measures the time for which the back door drawing mechanism 20*a* is operated to draw the back door 10. It is to be noted that when the timer 106 counts a given time (for example, 2.5 seconds), the control circuit 100 feeds the electric motor 35 with an electric power of reversed polarity, for reasons which will become apparent hereinafter. An open switch 108 is further connected to the control circuit 100, which is mounted, for example, on a dashboard of the motor vehicle.

In the following, operation of the back door closing device will be described with reference to the drawings.

For ease of understanding, the description will be commenced with respect to a full-open condition of the back door 10 as shown in FIG. 1.

Under this condition, the back door closing device 20*a* assumes a rest condition as shown in FIG. 4. That is, the latch plate 60 assumes the unlatch position and the locking plate 70 assumes the unlocking position keeping the locking pawl 73a in contact with one finger part 64 of the latch plate 60. The output pin 53 of the drive mechanism 50 is in its uppermost position causing the latch mounting plate 40 to take its upper position. Furthermore, the stopper portion 92 of the cam follower member 90 abuts against the tail end surface 76a of the locking plate 70.

Figure 5:
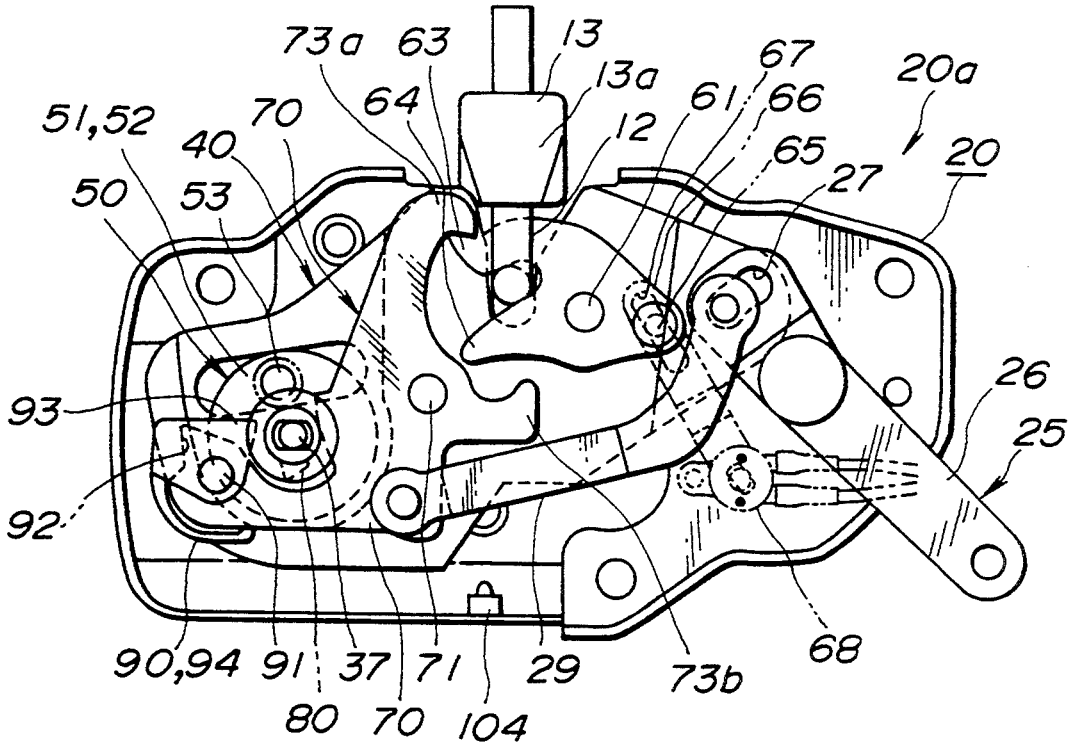

When now the back door 10 is pivoted down manually, the striker 12 secured thereto is moved downward and finally inserted into the triangular recess 21 of the supporting base plate 20 (more specifically, the aligned recesses 21, 42 and 32 of the back door drawing mechanism 20*a*). During this downward movement, the striker 12 pushes down the finger portion 64 of the latch plate 60 against the biasing force of the spring 62. Thus, the latch plate 60 is forced to pivot counterclockwise in FIG. 4 to the latch position forcing the other finger part 63 thereof to get over the locking pawl 73*a* of the locking plate 70. Thus, upon the latch plate 60 assuming the latch position, the locking plate 70 is pivoted by the force of the spring 72 to assume the locking position as shown in FIG. 5. During this pivot movement of the locking plate 70, the cam follower member 90 moves together with the locking plate 70 keeping the contact of the stopper portion 92 against the tail end surface 76*a* of the locking plate 70.

Thus, the locking pawl 73*a* of the locking plate 70 now locks the other finger part 63 of the latch plate 60 thereby to suppress the latch plate 60 from returning to the unlatch position. As is understood from FIG. 5, the wedge front portion 13*a* of the damper member 13 of the striker 12 does not contact both the peripheral edge of the triangular recess 21 of the supporting base plate 20 and that of the triangular recess 42 of the latch mounting plate 40. It is to be noted that when the back door 10 is violently pivoted down, the wedge front portion 13*a* of the damper member 13 becomes in contact with the peripheral edge of the triangular recess 42 of the latch mounting plate 40 to damp the impact shock. Even in this case, the wedge front portion 13*a* does not contact the peripheral edge of the recess 21 of the supporting base plate 20.

Figure 6:
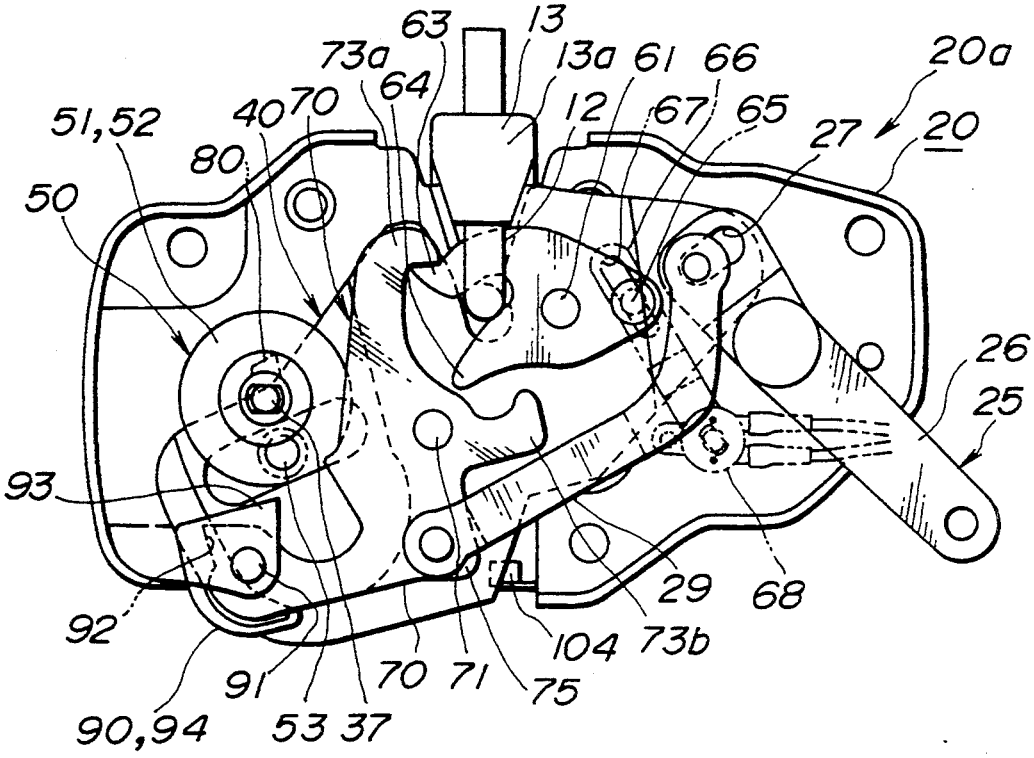
Figure 7:
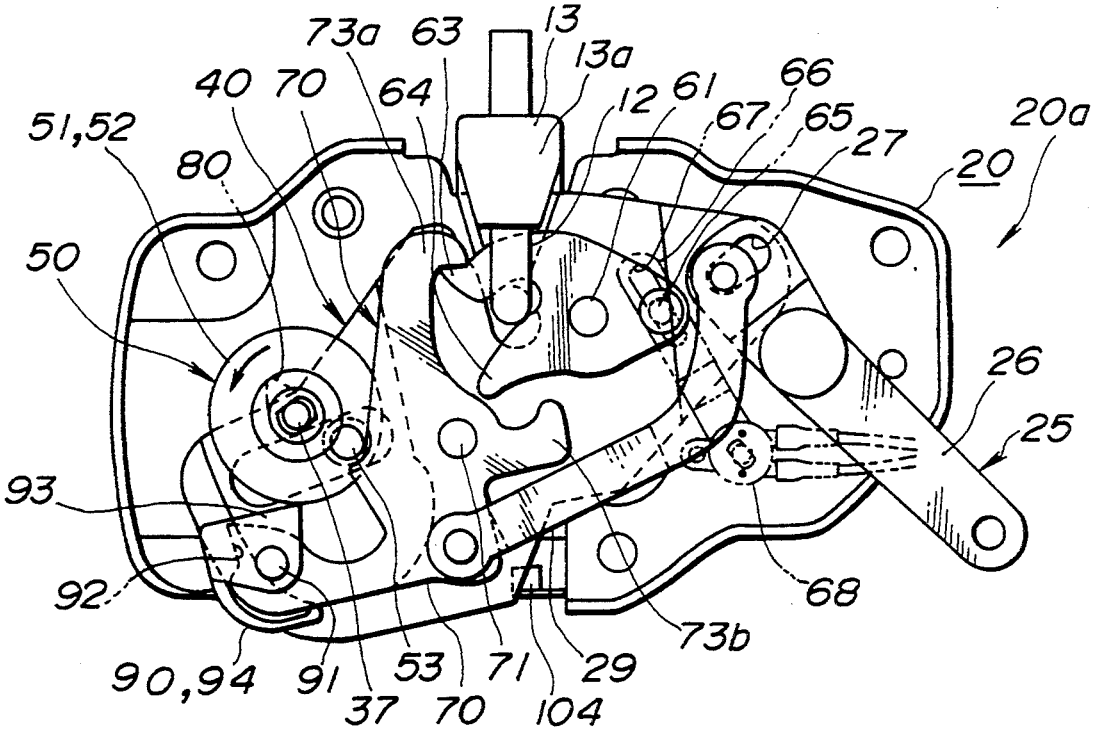
Figure 8:
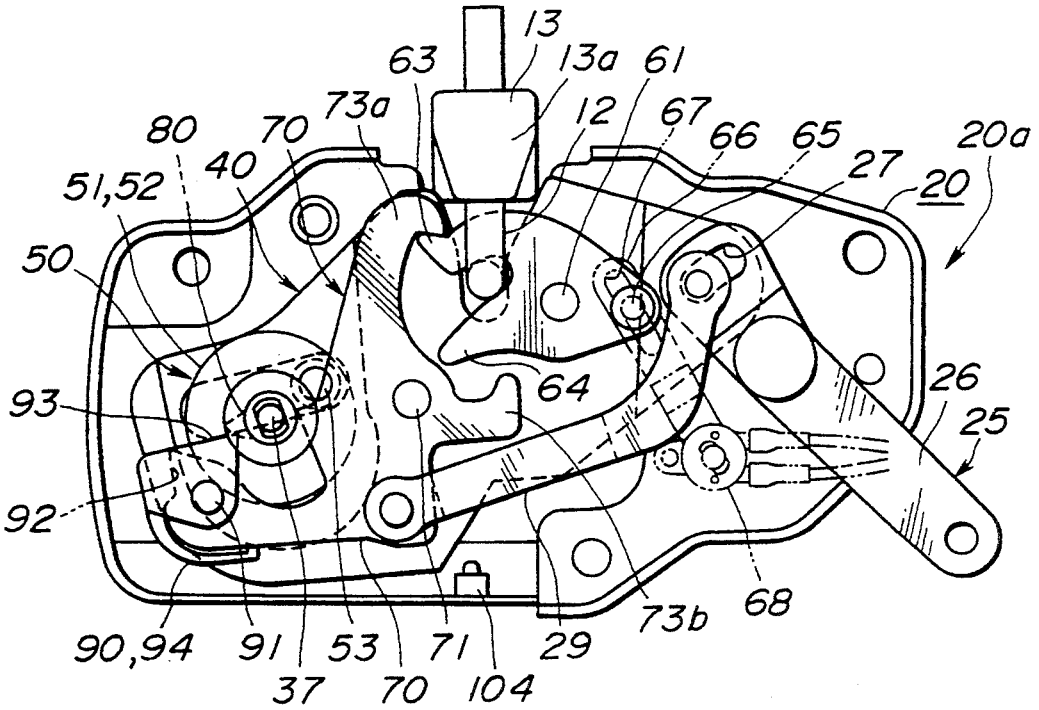
Figure 9:
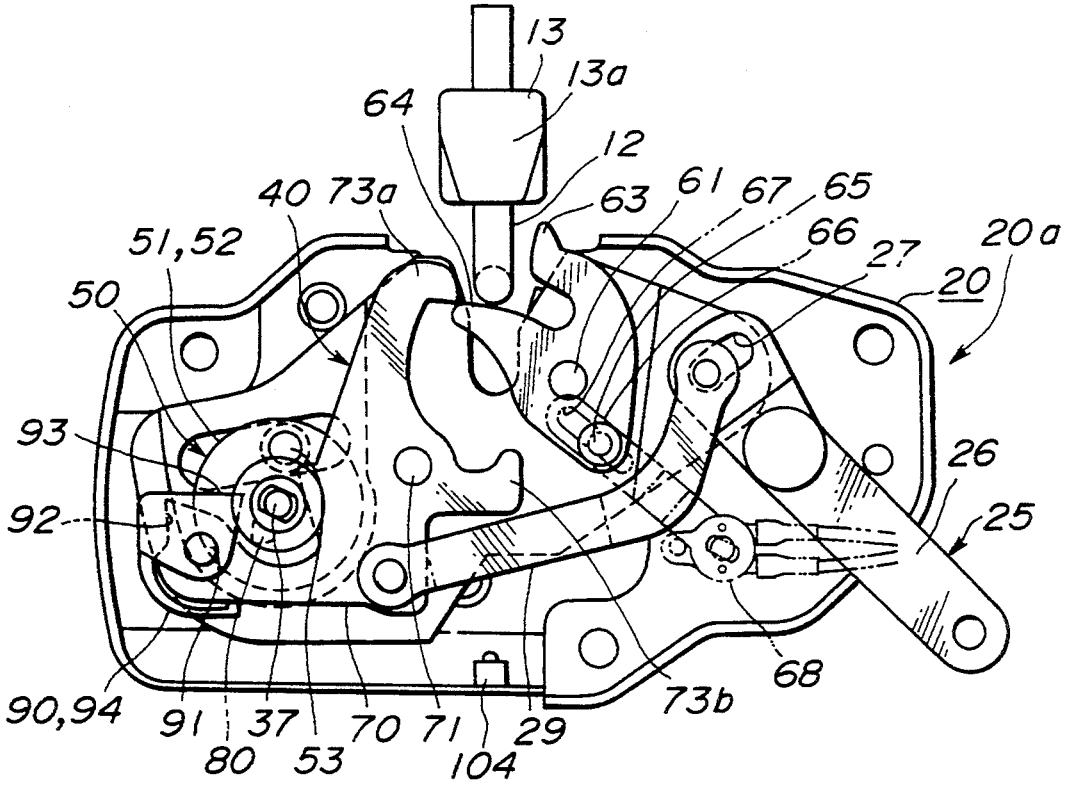

Due to the pivot movement of the latch plate 60 from the unlatch position to the latch position, the detection lever 66 is pivoted causing the rotary switch 68 to issue ON signal representing such pivot movement. Upon receiving such ON signal from the rotary switch 68, the electric motor 35 is energized to rotate the output Shaft 37 of the speed reduction gear 36. Thus, the paired circular output members 51 and 52 are rotated in a clockwise direction in FIG. 5 causing that the output pin 53 moves down from the uppermost position while sliding in and along the elongate slot 43 of the latch mounting plate 40. Thus, the latch mounting plate 40 is pivoted down about the pivot shaft 41. Because, as is described hereinabove, one side of the peripheral edge of the triangular recess 42 of the latch mounting plate 40 is somewhat bulged, the downward pivoting of the plate 42 is smoothly made without causing a frictional abutment of the striker 12 against the peripheral edge of the recess 42. When, due to continuous movement of the clockwise rotation of the paired circular output members 51 and 52, the output pin 53 comes to its lowermost position, the latch mounting plate 40 is pivoted to the lower position as shown in FIG. 6. Upon the latch mounting plate 40 reaching the lower position, a limit switch 104 (see FIG. 6) issues OFF signal to the electric motor 35 to stop operation of the same. Upon this, the back door 10 is fully closed. Under this condition, the wedge front portion 13a of the damper member 13 is tightly held by the peripheral edge of the triangular recess 21 of the supporting base plate 20, which can provide the damper door 10 with a stable closed position. It is to be noted that, when the latch mounting plate 40 assumes the lower position, the triangular recess 42 of the plate 40 is positioned below the triangular recess 21 of the supporting base plate 20. Thus, during the downward movement of the latch mounting plate 40 to the lower position, the damper member 13 (more specifically, the wedge front portion 13*a* of the damper member 13) of the striker 12 is released from the triangular recess 42 of the plate 40 and squeezed into the triangular recess 21 of the supporting base plate 20.

During the clockwise rotation of the paired circular output members 51 and 52, the cam member 80 rotates together therewith pushing the engaging portion 93 of the cam follower member 90 against a counterforce produced by the curved tongue portion 94 of the lever 90. Thus, the cam follower member 90 is forced to pivot in a counterclockwise direction in FIG. 5 about the pivot pin 91 separating the stopper portion 92 from the tail end surface 76a of the locking plate 70. Thus, during this, the locking plate 70 keeps the locking position. When thereafter a bulge portion of the cam member 80 passes over the engaging portion 93 of the cam follower member 90, the cam follower member 90 is pivoted in clockwise direction in FIG. 5 by the force generated by the curved tongue portion 94 and thus returned to its original position wherein the stopper portion 92 of the cam follower member 90 contacts the tail end surface 76a of the locking plate 70, as shown in FIG. 6.

The downward pivoting of the latch mounting plate 40 from the upper position to the lower position is carried out against counterforces produced by both the wedge-shaped damper member 13 of the striker 12 and the weather strip (see FIG. 1) fixed to the periphery 16 of the door opening 14. When the back door 10 assumes the fully closed locked position, the back door drawing mechanism 20*a* assumes the condition as shown in FIG. 6, as is mentioned hereinabove.

When, for the purpose of opening the back door 10, the open switch 108 (see FIG. 2) is manipulated, the control circuit 100 energizes the electric motor 35. With this, the paired circular output members 51 and 52 are rotated in a clockwise direction in FIG. 6 causing the output pin 53 moves up from the lowermost position while sliding in and along the elongate slot 43 of the latch mounting plate 40. Thus, the latch mounting plate 40 is pivoted upward from the lower position to the upper position. During the clockwise rotation of the paired circular output members 51 and 52, the cam member 80 rotates in the same direction pressing, at its bulge portion, the engaging portion of the cam follower member 90. The pressing against the cam follower member 90 forces the locking plate 70 to pivot from the locking position to the unlocking position causing a striker part 73b of the locking plate 70 to strike the finger part 64 of the latch plate 60. Thus, the latch plate 60 is pivoted from the latch position to the unlatch position with an aid of the biasing spring 62. Upon this, the detection lever 66 of the rotary switch 68 detects the unlatched condition of the striker 12 and deenergizes the electric motor 35. The back door drawing mechanism 20*a* now assumes the condition as shown in FIG. 4. Thus, the back door 10 is now ready for opening by hands.

When, with the back door 10 kept fully closed (see FIG. 6), the key cylinder of the unlocking mechanism 25 is turned in a given direction by a key for the purpose of opening the back door 10, the connecting rod 29 pulls the junction part 75 of the locking plate 70. Thus, the locking plate 70 is pivoted about the pivot shaft 71 in a counterclockwise direction in FIG. 6 to take the unlocking position. Upon this, the latch plate 60 is permitted to pivot to the unlatch position by the force of the spring 62 and the force of the weather strip. Thus, the striker 12 of the back door 10 is released from the back door drawing mechanism 20a. Under this condition, the back door 10 can be opened when a certain external force is applied thereto by an operator.

Due to the pivot movement of the latch plate 60 to the unlatch position, the detection lever 66 of the rotary switch 68 detects such movement and energizes the electric motor 35. Upon this, the paired circular output members 51 and 52 are rotated in a clockwise direction in FIG. 6 causing that the output pin 53 moves up from the lowermost position while sliding in and along the elongate slot 43 of the latch mounting plate 40. Thus, the latch mounting plate 40 is pivoted upward from the lower position to the upper position, and thus the back door drawing mechanism 20a assumes the condition as shown in FIG. 4.

In the following, abnormal operation of the back door closing device will be described, which takes place when a foreign thing accidentally gets between the back door 10 and the vehicle body during closing movement of the back door 10.

When, during the door pulling operation of the back door drawing mechanism 20*a*, a foreign thing accidentally gets between the back door 10 and the vehicle body, the downward movement of the back door 10 toward the fully closed position is forced to stop. When the control circuit 100 fails to receive the OFF signal from the limit switch 104 within 2.5 seconds from the time when receiving the ON signal from the rotary switch 68, the control circuit 100 feeds the electric motor 35 with an electric power of reversed polarity. Thus, the electric motor 35 is rotated in a reversed direction causing the paired circular output members 51 and 52 in a counterclockwise direction as is seen from FIG. 7. During this, the cam member 80 rotates in the same direction and, after a while, presses the engaging portion 93 of the cam follower member 90, as is seen from FIG. 8. With this, the cam follower member 90 is pivoted in a clockwise direction bringing the stopper portion 92 thereof into abutment with the tail end surface 76*a* of the locking plate 70, resulting in that the locking plate 70 is pivoted to the unlocking position together with the cam follower member 90. Thus, as is seen from FIG. 9, the latch plate 60 is pivoted to the unlatch position due to the force of the spring 62 thereby releasing the striker 12 of the back door 10. Upon sensing the pivot movement of the latch plate 60, the detection lever 66 causes the rotary switch 68 to issue OFF signal to the control circuit 100 and thus stops operation of the electric motor 35. Thus, under this condition, the back door 10 is ready for opening by hands.

Figure 11:
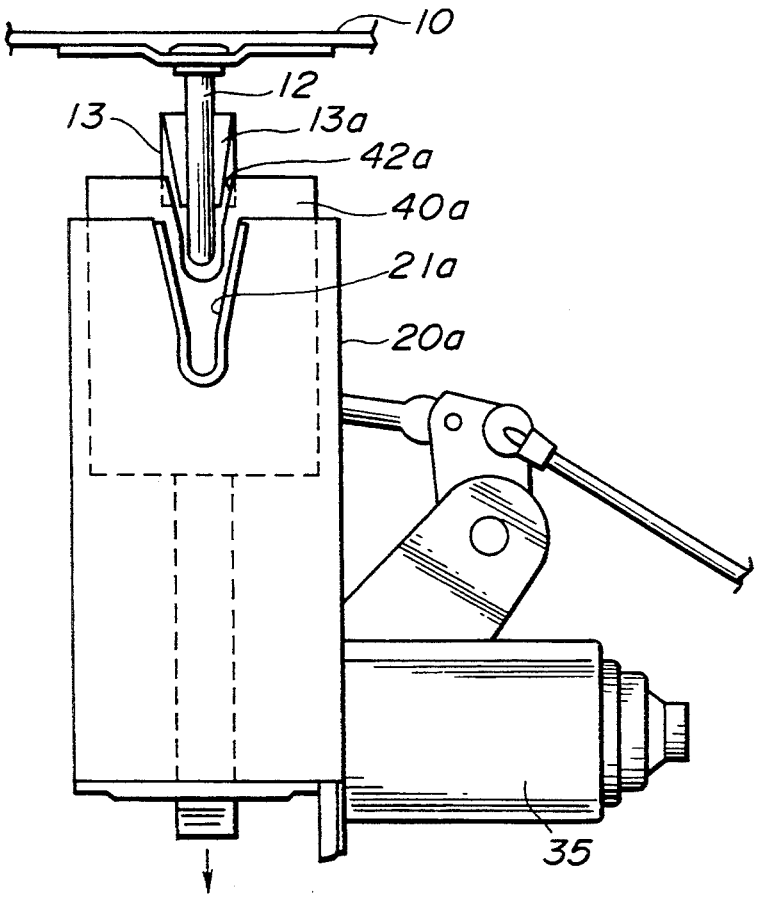
FIG. 11 is a front view of a modification of the back door closing device of the invention.
Figure 12:
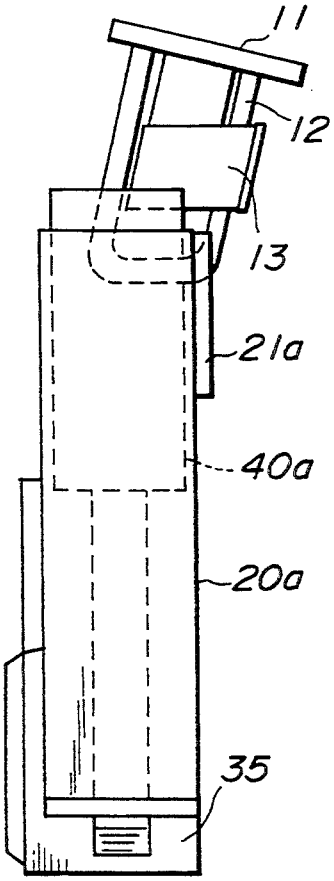
FIG. 12 is a side view of the modification of the back door closing device of the invention.
Figure 13:
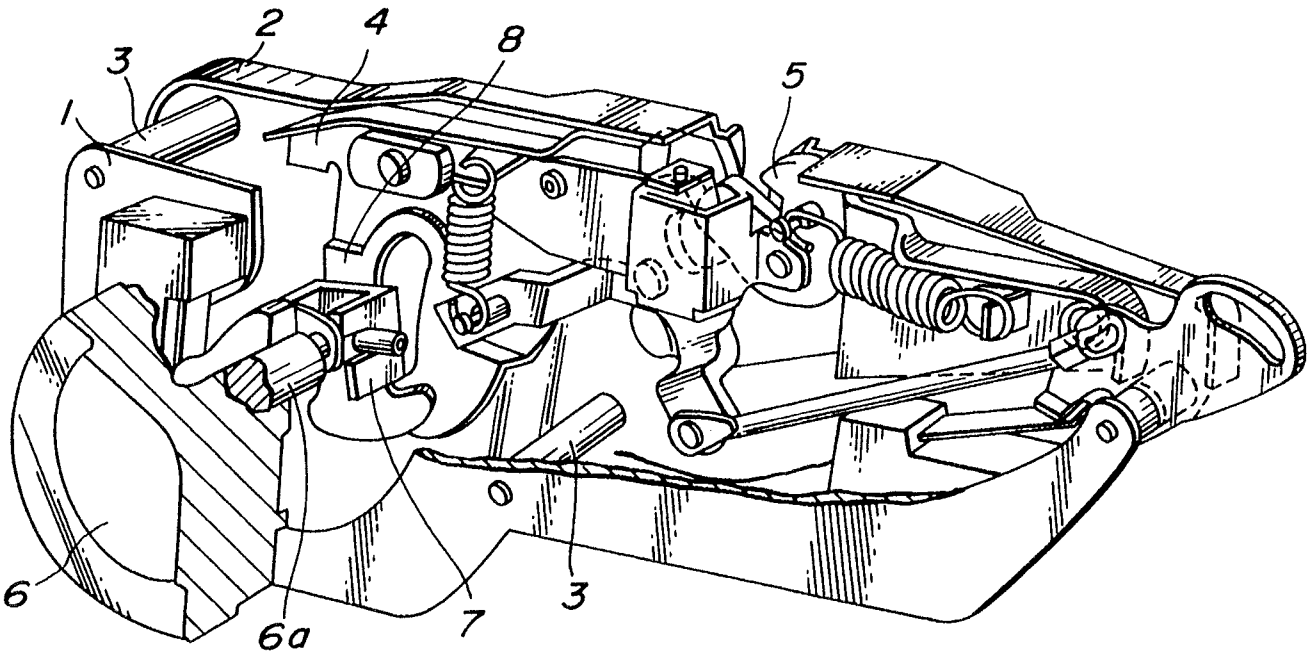
FIG. 13 (PRIOR ART)
FIG. 13 is a partially cut perspective view of a conventional back door closing device.
Figure 14:
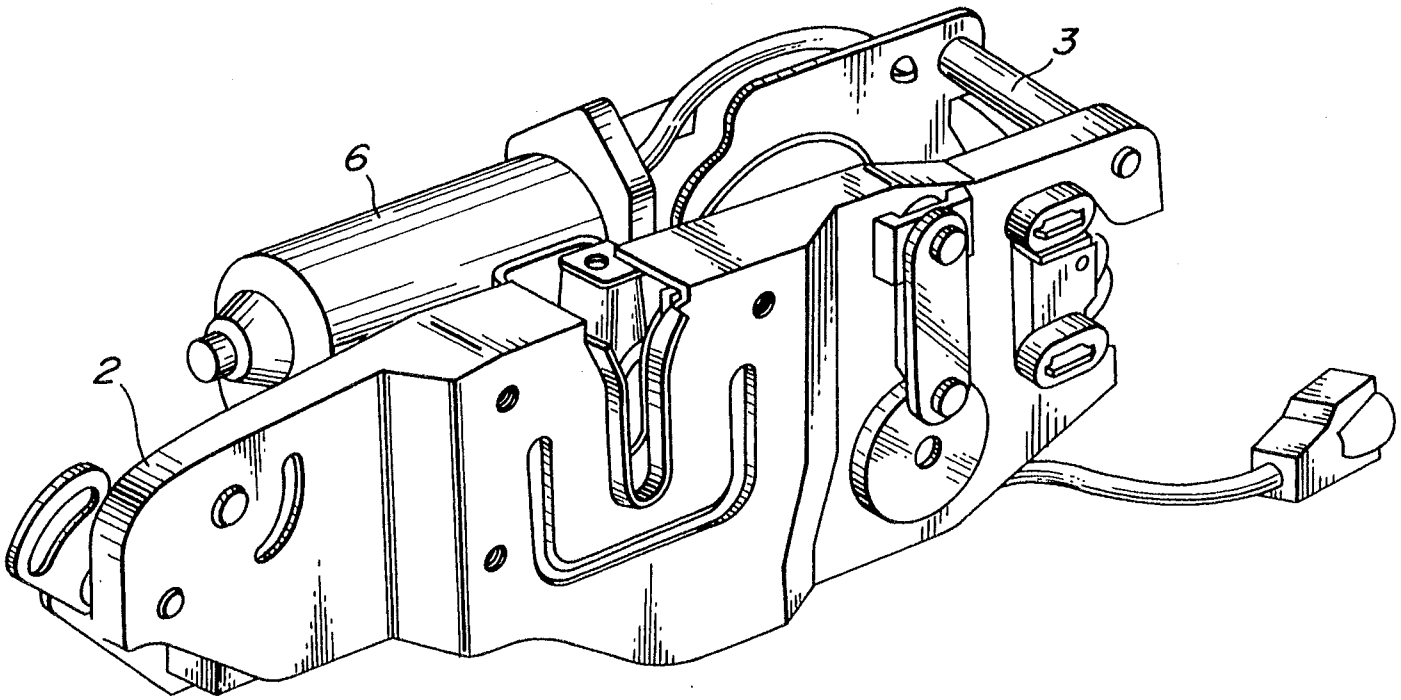
FIG. 14 (PRIOR ART)
FIG. 14 is a perspective view of the conventional back door closing device, which is taken from a front side of the device.

Referring to FIGS. 11 and 12, there is shown a modification of the back door closing device of the invention.

In this modification, the latch mounting plate 40*a* is constructed to move vertically along a straight way. That is, after engagement of the striker 12 of the back door 10 with the latch plate (not shown) on the latch mounting plate 40*a*, the latch mounting plate 40*a* is vertically moved downward by the electric motor 35 to a lower position. At this lower position, the triangular recess 42*a* of the latch mounting plate 40*a* is positioned below the triangular recess 21*a* of the supporting base plate 20*a*. Because of provision of the wedge front portion 13*a* of the damper member 13, upon full closing of the damper door 10, the damper member 13 can be tightly held by the peripheral edge of the recess 21*a* of the supporting base plate 20*a* even when the recess 42*a* of the latch mounting plate 40*a* is moved down away from the damper member 13. Thus, also this modification can provide the back door 10 with a stable fully closed position.

What is claimed is:

1. A powered closing device for use in a structure wherein a first member is pivotally connected to a second member, comprising:

a striker secured to said first member to move therewith;

a drawing mechanism mounted on said second member for catching and pulling down said striker to a certain lower position, said drawing mechanism including a supporting base plate secured to said second member, a latch mounting plate pivotally connected to said supporting base plate, a latch plate pivotally connected to said latch mounting plate and pivoting between a latch position to latch said striker and an unlatch position to release said striker, and a locking plate pivotally connected to said latch mounting plate and pivoting between a locking position to lock said latch plate at said latch position and an unlocking position to release said latch plate;

a drive mechanism for driving said latch mounting plate to pivot between upper and lower positions by the force of electric power; and an emergency mechanism which, during the time when said drawing mechanism is pulling down said striker with the aid of said driving mechanism, forces said locking plate to pivot from said locking position to said unlocking position thereby to release said striker from said drawing mechanism, wherein said emergency mechanism comprises:

a cam member powered by said drive mechanism, said cam member being rotatable about its axis in both one and the other directions;

a cam follower member pivotally connected to said locking plate, said cam follower member being actuated by said cam member in such a manner that when said cam member is rotated in one direction, said cam follower member forces said locking plate to keep said locking position and when said cam member is rotated in the other direction, said cam follower member forces said locking plate to pivot from said locking position to said unlocking position.

2. A powered closing device as claimed in claim 1, in which said cam follower member comprises:

a stopper portion which is contactable with a first portion of said locking plate;

an engaging portion against which said cam member is operatively engageable; and a curved tongue portion having a leading end, said leading end abutting against a second portion of said locking plate.

3. A powered closing device as claimed in claim 2, in which said locking plate is generally in the shape of letter "L", which comprises:

a first arm part equipped with both a locking pawl and a striker part between which an essential portion of said latch plate is held when said locking plate assumes said locking position;

a second arm part equipped with said first and second portions; and a junction part at which said first and second arm part are united, said junction part being pivotally connected to said latch mounting plate through a pivot shaft.

4. A powered closing device as claimed in claim 3, in which said drive mechanism comprises:

an electric power unit having an output shaft by which the cam member of said emergency mechanism is rotated;

a circular output structure rotated by said output shaft;

an output pin connected to a peripheral portion of said circular output structure;

means defining in said latch mounting plate an elongate slot in which said output pin is slidably received.

5. A powered closing device as claimed in claim 4, in which said drive mechanism further comprises a sleeve which is rotatably disposed about said output pin and slidably received in the elongate slot of said latch mounting plate.

6. A powered closing device as claimed in claim 4, in which said circular output structure comprises a pair of circular output members which are arranged to put therebetween said latch mounting plate.

7. A powered closing device as claimed in claim 1, further comprising an unlocking mechanism which includes:

an output lever pivotally connected to said supporting base plate;

means defining in one end portion of said output lever an elongate slot; and a connecting rod having at its one end a stud which is slidably engaged with the elongate slot of said output lever, said connecting rod being pivotally connected at the other end to said locking plate.

8. A powered closing device as claimed in claim 7, further comprising a latch plate position detecting means which includes:

a rotary switch mounted to said supporting base plate;

a detection lever connected to said rotary switch to actuate the same;

means defining in said detection lever an elongate slot; and a pin secured to said latch plate, said pin being slidably engaged with the elongate slot of said detection lever.

9. A powered closing device as claimed in claim 1, further comprising:

a wedge-shaped damper member mounted to said striker; and tightly holding means for causing said drawing mechanism to tightly hold said wedge-shaped damper member when said first member assumes a given angular position relative said second member.

10. A powered closing device as claimed in claim 9, in which said tightly holding means comprises:

means defining in said supporting base plate a generally triangular recess into which said striker can be inserted; and means defining in said latch mounting plate a generally triangular recess into which said striker can be inserted, wherein said recesses of said supporting base plate and said latch mounting plate are so shaped as to tightly hold said wedge-shaped damper member when said first member assumes a fully closed position relative to said second member.

11. A powered closing device as claimed in claim 10, in which the pivoting connection of said latch mounting plate relative to said supporting base plate is so made that when, due to operation of said drawing mechanism, said latch mounting plate is pivoted down to its lowermost position while pulling down said striker through said latch plate, the triangular recess of said latch mounting plate becomes positioned below the triangular recess of said supporting base plate.

12. A powered closing device as claimed in claim 11, in which one side of the peripheral edge of the triangular recess of said latch mounting plate somewhat bulges as compared with the other side.

13. A powered closing device as claimed in claim 12, in which the angle defined by the opposed sides of said peripheral edge of said latch mounting plate is larger than that of said supporting base plate.

* * * * *